United States Patent [19]

Rhodes

[11] 4,021,658

[45] May 3, 1977

[54] ANGULAR RATE DERIVING APPARATUS

[75] Inventor: Melvin H. Rhodes, Cedar Rapids, Iowa

[73] Assignee: Rockwell International Corporation, El Segundo, Calif.

[22] Filed: Sept. 22, 1975

[21] Appl. No.: 615,756

[52] U.S. Cl. ..... 235/183; 235/186; 235/194; 328/127; 340/347 AD

[51] Int. Cl.[2] ..... G06G 7/18; G06G 7/22

[58] Field of Search ..... 235/183, 186, 193, 194; 307/229, 235 N, 271; 328/127, 132, 144, 185; 332/23 R; 340/347 AD

[56] References Cited

UNITED STATES PATENTS

| | | | |
|---|---|---|---|
| 3,482,116 | 12/1969 | James | 307/235 N X |
| 3,514,719 | 5/1970 | Rhodes | 332/23 R |
| 3,539,825 | 11/1970 | Hardaway | 328/185 X |
| 3,588,713 | 6/1971 | Yareck | 235/194 X |
| 3,714,470 | 1/1973 | Goldberg | 307/229 X |
| 3,778,794 | 12/1973 | Szabo et al. | 307/229 X |
| 3,921,084 | 11/1975 | Kratt et al. | 328/127 X |

OTHER PUBLICATIONS

D. F. Hoeschele, Jr., *Analog-to-Digital/-Digital-to-Analog Conversion Techniques*, Wiley & Sons Inc., 1968, pp. 356–357.

*Primary Examiner*—Jerry Smith
*Attorney, Agent, or Firm*—Bruce C. Lutz; Robert J. Crawford

[57] ABSTRACT

The circuitry illustrated utilizes duty cycle conversion means for providing signals indicative of Sin and Cos of an angle $\theta$ as well as the derivative of Sin$\theta$ and Cos$\theta$. The derivative signals are then duty cycle multiplied by the Sin$\theta$ and Cos$\theta$ signals and the products are summed to provide an output $d\theta/dt$ which is indicative of angular rate of change.

4 Claims, 10 Drawing Figures

(FIG. 1)

ANGULAR RATE DERIVING APPARATUS

THE INVENTION

The present invention is generally related to electronics and more specifically related to a circuit for providing angular rate of change indications.

It is realized that there are other circuits for obtaining angular rate of change and one example is my U.S. Pat. No. 3,514,719 issued May 26, 1970 and assigned to the same assignee of the present invention. However, it is believed that the duty cycle signal conversion and multiplication process provides a simpler, yet superior product. Further, one embodiment of the invention utilizes normalization to reduce the effects of errors in the supplied Sin$\theta$ and Cos$\theta$ signals.

It is therefore an object of the present invention to provide an improved angular rate deriving circuit.

Other objects and advantages of the present invention may be ascertained from a reading of the specification and appended claims in conjunction with the drawings wherein:

Figure 7:
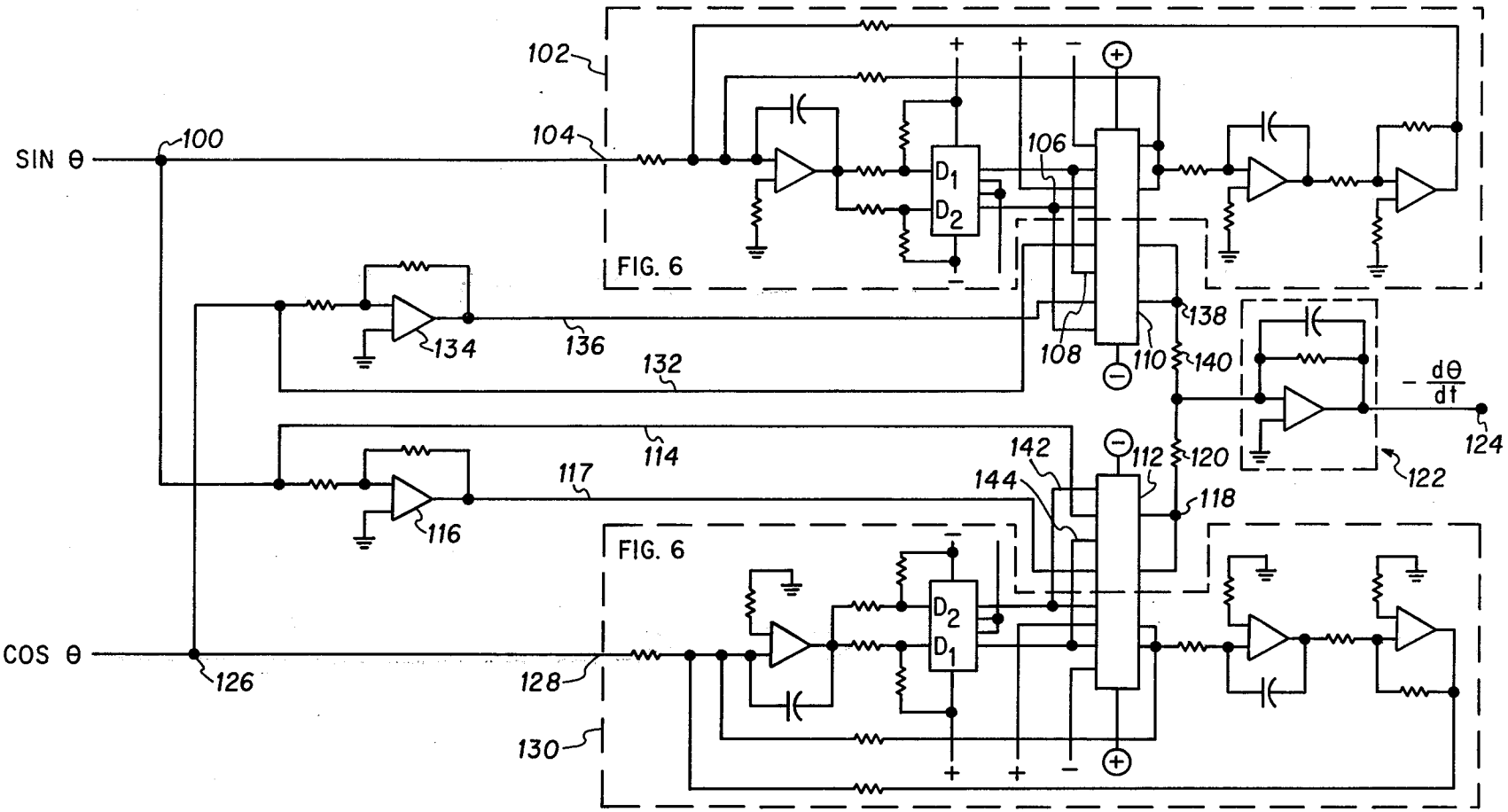
FIG. 7 is a circuit diagram utilizing the circuit of FIG. 6 for providing angular rate of change.
Figure 9:
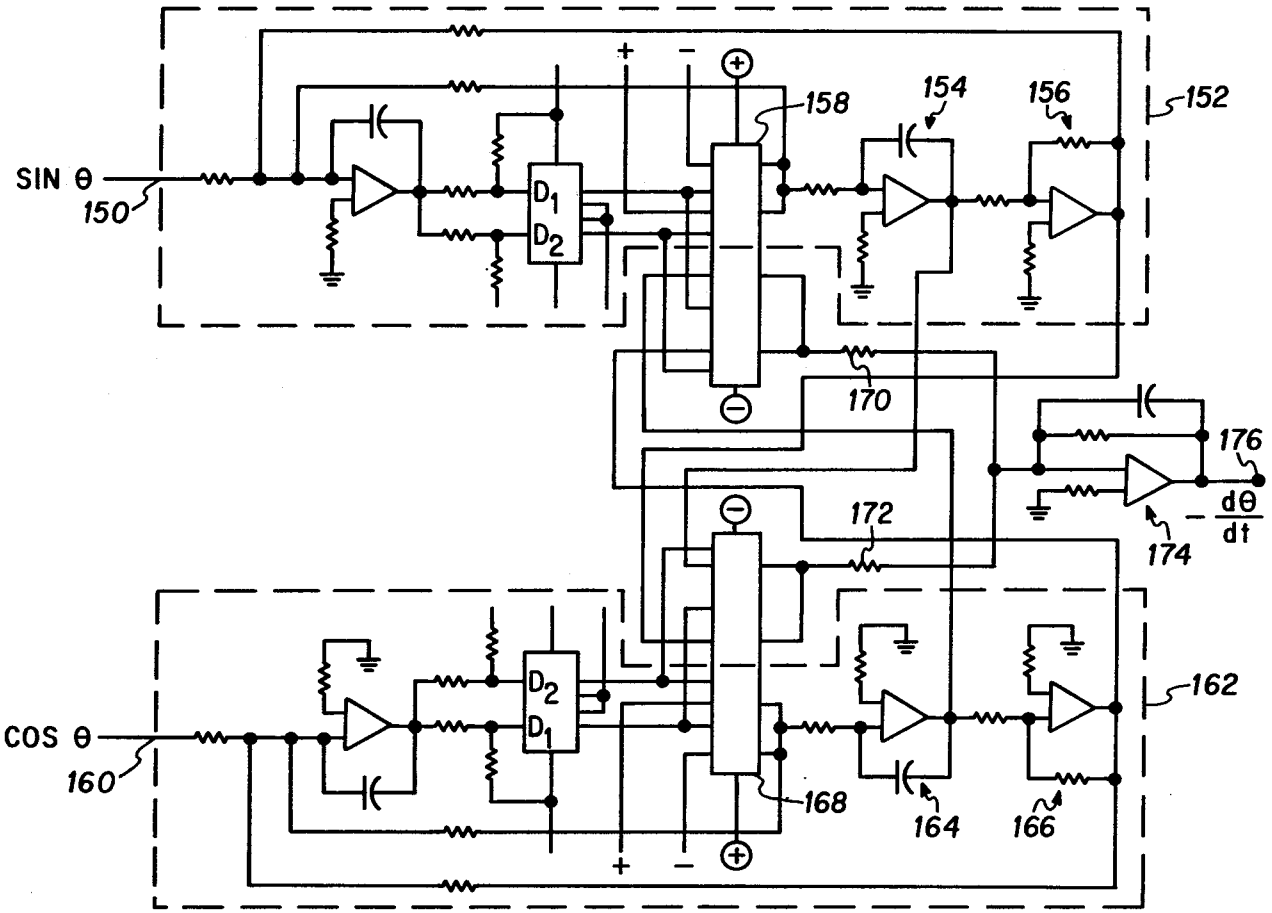
FIG. 9 is a component minimization of the circuit of FIG. 7.
Figure 10:
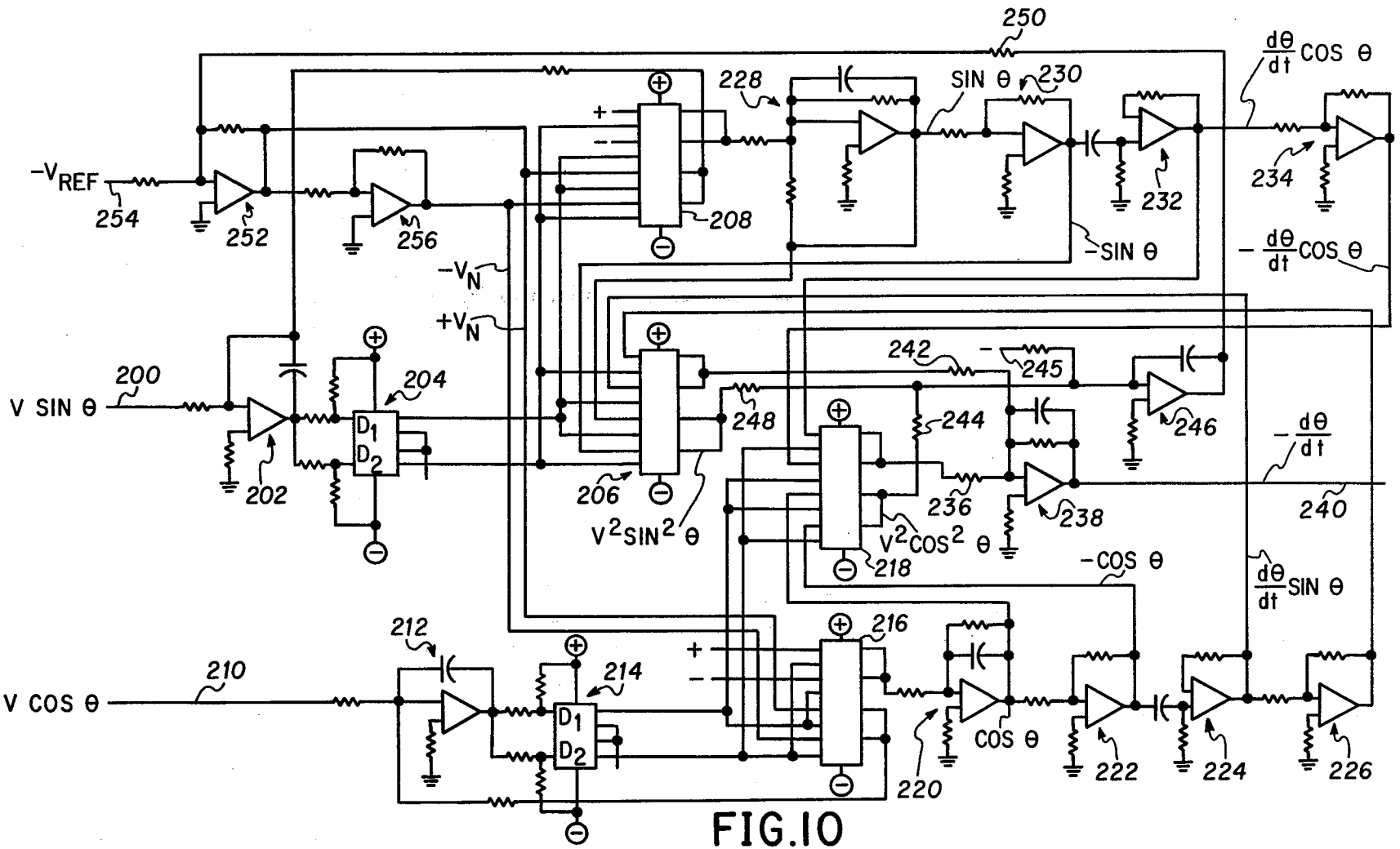

FIG. 10 accomplishes the teachings of the invention in an alternate method from that of FIGS. 7 and 9.

DETAILED DESCRIPTION OF FIGS. 1–5

Figure 1:
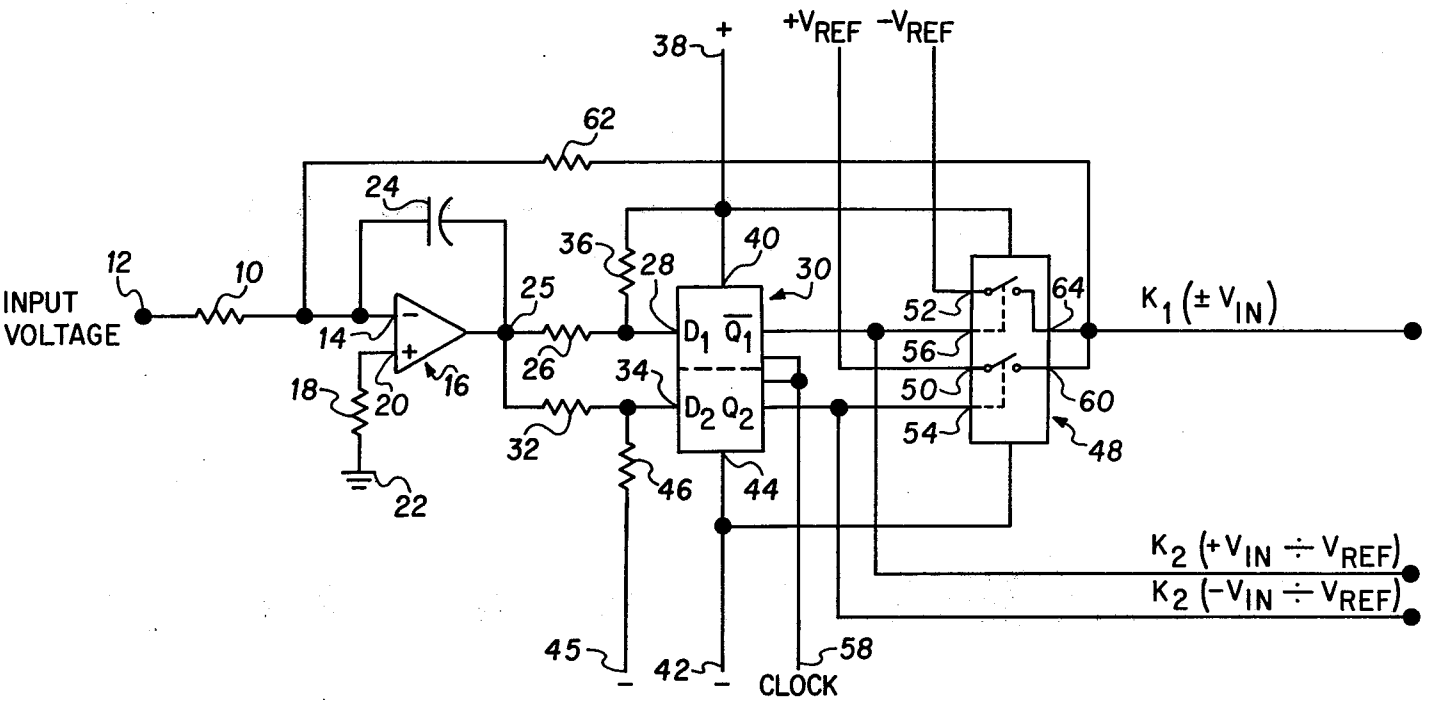
FIG. 1 is a schematic diagram of a duty cycle converter.

In the converter multiplier apparatus of FIG. 1, a resistor 10 is connected between an input terminal 12 and a negative or inverting input 14 of a differential amplifier 16. A resistor 18 is connected between a non-inverting or positive input 20 of amplifier 16 and ground or reference potential 22. An integrating capacitor 24 is connected between an output 25 of amplifier 16 and input 14. A resistor 26 is connected between output 25 and a D1 or upper flip-flop input 28 of a dual D-type flip-flop block or voltage sensitive switch means generally designated as 30. This dual D-type flip-flop block may be of the type sold as part number CD4013 by RCA. This type of flip-flop contains two separate D flip-flops and although each contains both a Q and $\overline{Q}$ output, the requirements of this circuit utilize only the $\overline{Q}$ or false output for the upper flip-flop and the Q or true output for the lower flip-flop. A resistor 32 is connected between the output 25 of amplifier 16 and a D2 or lower flip-flop input 34 of block 30. A further resistor 36 is connected between input 28 of block 30 and a positive power potential generally designated as 38 which is also connected to a power input terminal 40 on dual D flip-flop 30. A negative power potential 42 is connected to a negative power input 44 of flip-flop 30. A further negative power source 45 (which may be the same as 42) is connected through a resistor 46 to the D2 input 34. Terminals 38 and 42 also supply positive and negative power respectively to an analog switch 48 which is shown schematically in internal connections as having first and second signal inputs 50 and 52 respectively connected to positive and negative reference voltage sources respectively. The switches or gates forming a part of these two input leads of block 48 are controlled by input terminals 54 and 56, respectively. Input 54 is connected to a $Q_2$ output of dual flip-flop 30 and is energized in accordance with D logic flip-flop when a logic 1 appears on input 34 and a rising clock pulse is simultaneously supplied from a clock input 58 to the flip-flop 30. Input 56 of block 48 is connected to the $\overline{Q_1}$ output of the upper D flip-flop of block 30 and becomes a logic 1 when a signal to input 28 is effectively a logic 0 and the clock on lead 58 is rising in potential. When a logic 1 is presented on lead 54, the input signal or reference potential $+V_{ref}$ from lead 50 is connected to an output 60 and supplied through a resistor 62 to input 14 of amplifier 16. When a logic 1 appears at input 56, the switch connected to lead 52 is closed and an output appears at output 64 so as to supply the negative reference voltage through resistor 62 to the input of amplifier 16.

In FIGS. 2–5, a clock occurs at the indicated times for waveform A. A break between clocks 16 and 24 in FIG. 2 indicates an indeterminate elapsed time. Waveform B indicates the signal appearing at input 12 of FIG. 1. The waveform C is indicative of the signal being supplied from the output of block 48 to the resistor 62. Waveform D is indicative of that appearing at the output of integrator amplifier 16. Waveform E is indicative of the signal appearing at input 28 of the $D_1$ upper dual D flip-flop. Waveform F is indicative of the waveform appearing at input 34 of the $D_2$ lower D flip-flop. Waveform G is indicative of the signal appearing at the $\overline{Q_1}$ output of the upper flip-flop while waveform H is indicative of the signal appearing at the $Q_2$ output of the lower flip-flop.

Figure 2:
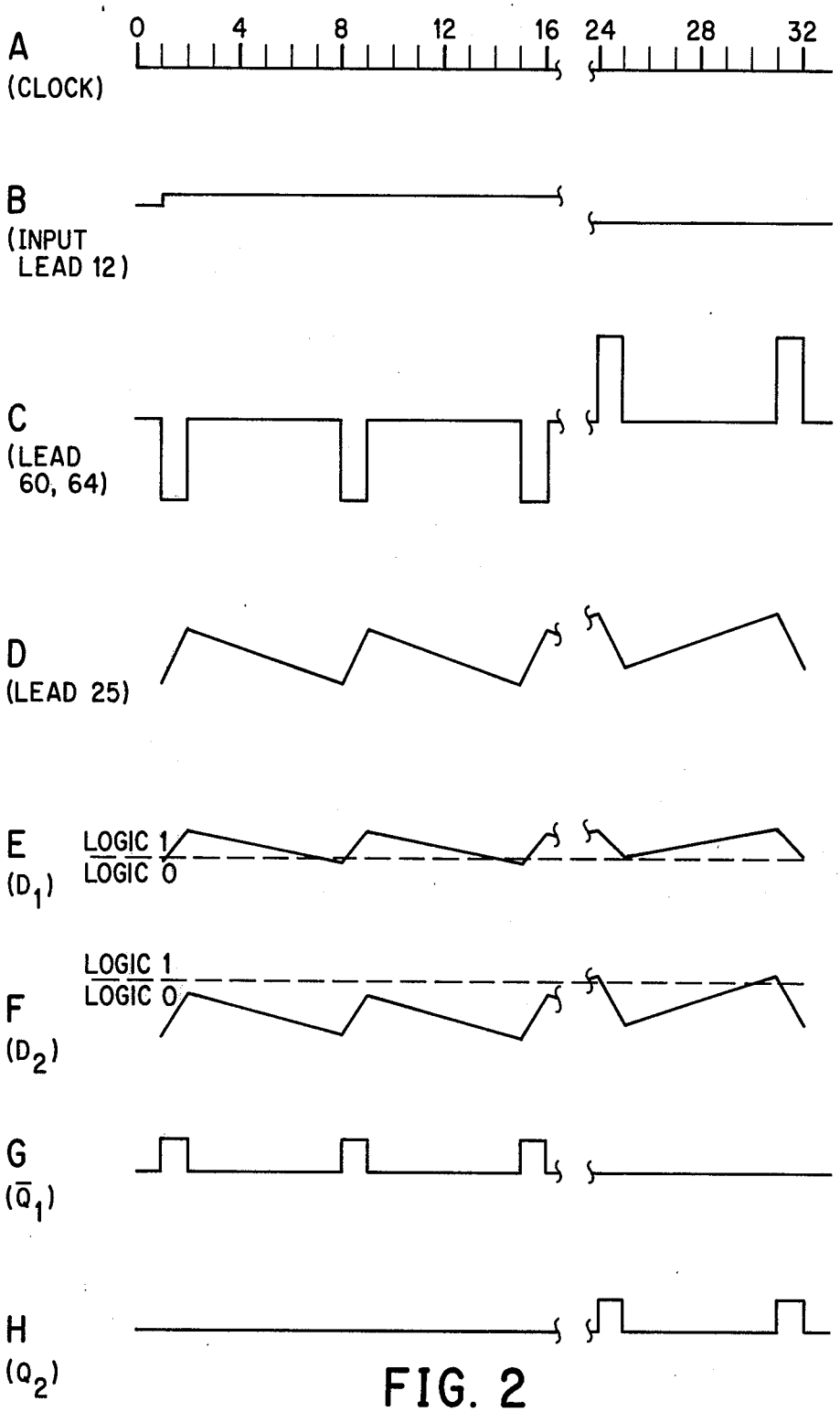
FIG. 2–5 are waveforms utilized in explaining the operation of FIG. 1.
Figure 3:
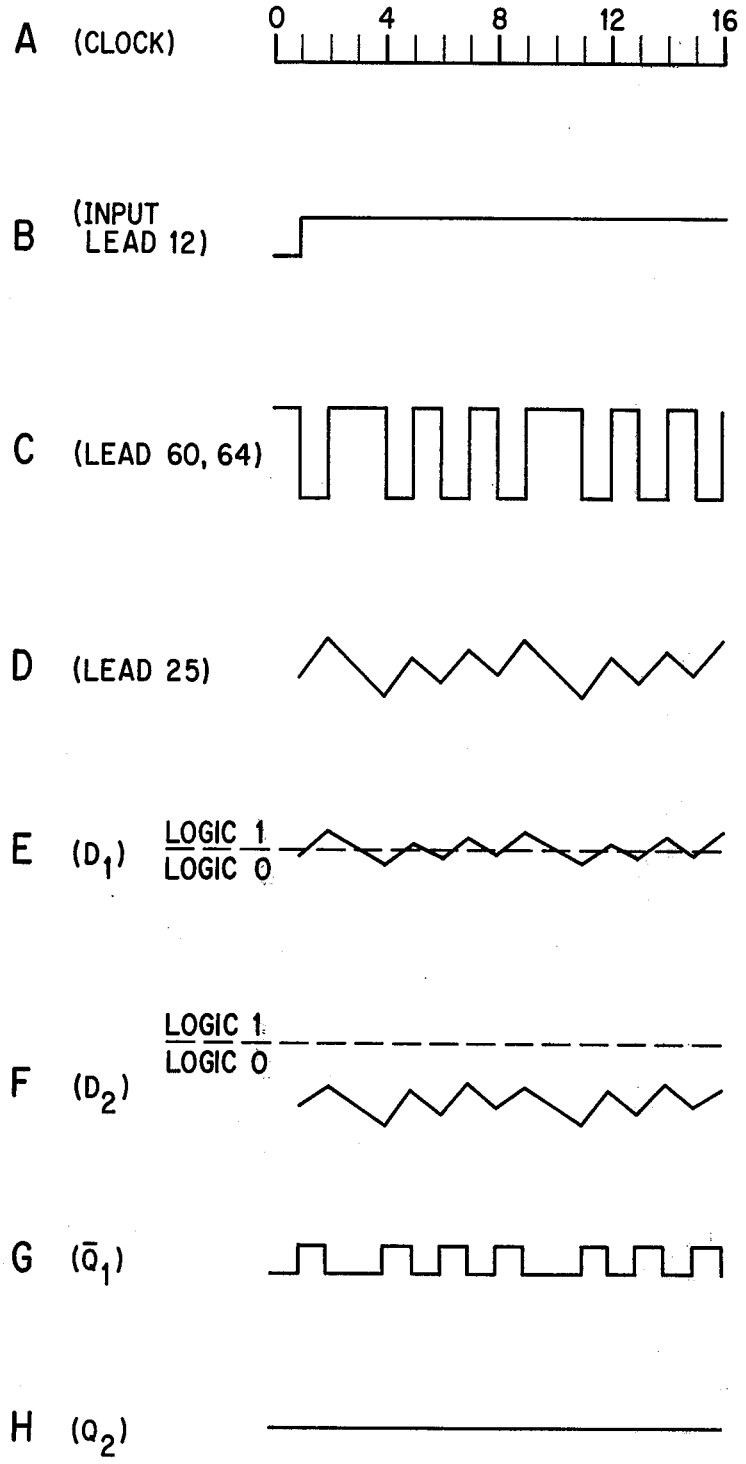

In FIGS. 2 and 3, the reference voltages being applied on leads 50 and 52 are kept at the same constant levels which for the purposes of illustration may be assumed to be 7 volts while the potential at input 12 is changed.

Figure 4:
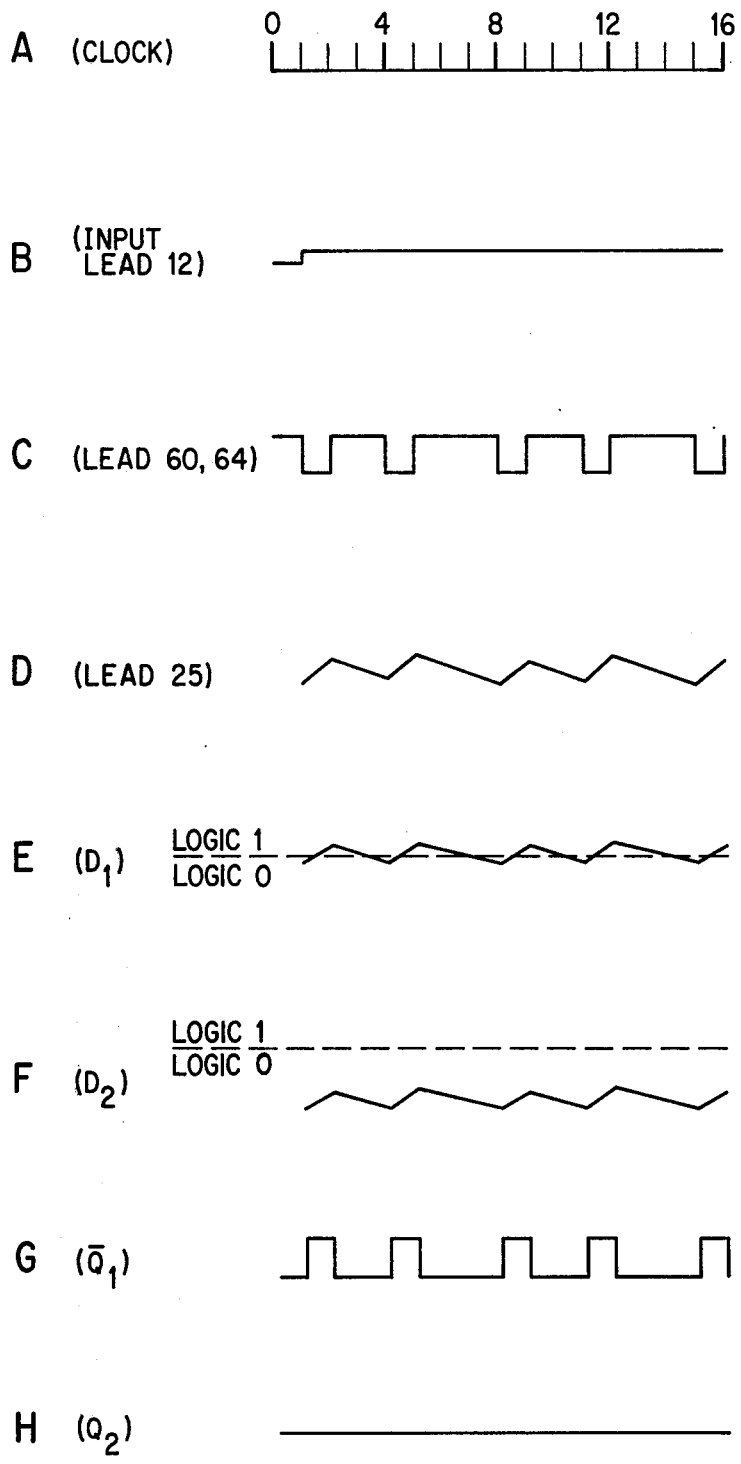
Figure 5:
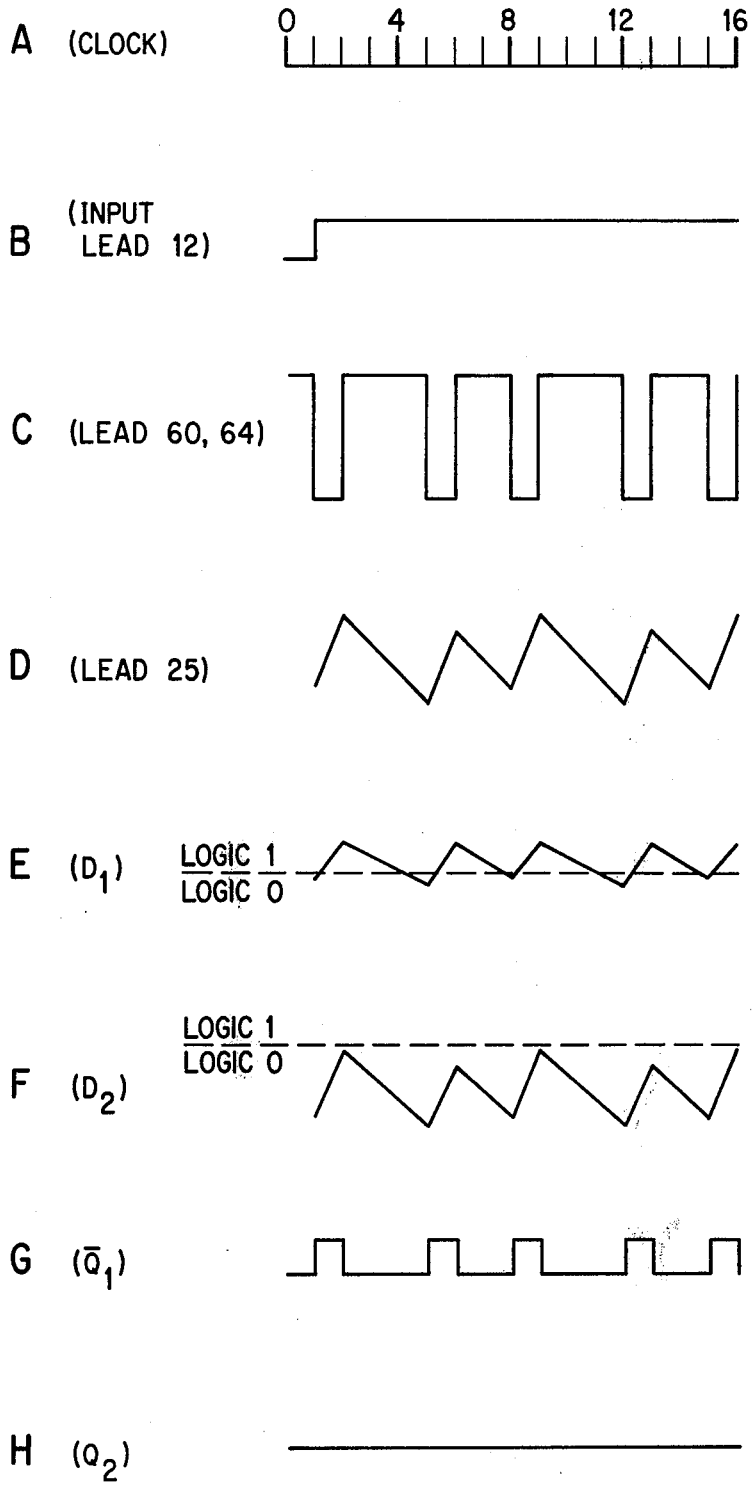

In FIGS. 4 and 5, the input potentials illustrated in FIGS. 2 and 3 are used while the reference potential voltages appearing on leads 50 and 52 are altered to illustrate the effects of changing the reference voltage upon the output signal.

The circuit of FIG. 1 is designed to alter an analog input voltage to a plurality of output pulses of positive and negative values which may be used in conjunction with further circuitry as illustrated in my copending applications Ser. Nos. 615,755, 615,758 and 615,753 filed September 22, 1976 wherein, as an example, an output may be obtained indicative of rate of change of the input signal.

It may be noted that the analog switch 48 may be of the type sold by RCA under the part number CD4016A, and designated as a COS/MOS Quad bilateral switch. Switch 48 would utilize two of the switch sections of such a switch. While RCA circuits have been designated as being usable in the circuits of this invention, it is obvious to those skilled in the art that other types of voltage sensitive switches and other switches may be used and that these are exemplary only.

OPERATION OF FIGS. 1–5

In operation, a positive polarity input signal is supplied to lead 12 and it passes through resistor 10 to start charging the integrating capacitor 24 feeding signals back from the output to the input of amplifier 16. As the capacitor commences charging, it will attempt to lower the potential of the output of integrator 16. However, from a starting condition at clock pulse No. 1, the D1 input will normally be a logic 0 and thus the $\overline{Q_1}$ output will simultaneously activate the switch associated with the negative reference voltage. A negative reference voltage will be fed back through resistor 62 to the integrating amplifier 16. For purposes of explanation, it may be assumed that the reference voltage is much larger than the input voltage. Thus, the negative voltage will override the effects of the signals appearing on lead 12 and will, after being inverted in amplifier 16, commence the output signal being driven in the positive direction so as to raise the potential on inputs D1 and D2. It will be noted that there is a bias so that at all times the input D1 is at a higher potential than input D2, since there is a voltage divider network comprising resistors 36, 26, 32 and 46 between the positive and negative potentials 38 and 45, respectively. Thus, as the output potential rises, input D1 will pass from the logic 0 condition to the logic 1 condition before input D2 passes from the logic 0 condition to the logic 1 condition. As will be noted, a logic 1 output is obtained from the $\overline{Q_1}$ output only when D1 is in a logic 0 condition and a logic 1 output is obtained from the $Q_2$ output only when D2 is in a logic 1 condition. Thus, at some point, flip-flop D1 will no longer maintain a logic 1 output to input 56 and at some later point in time as the output from integrator amplifier 16 is rising, the lower flip-flop is activated and there is a logic 1 appearing on input 54 so as to supply positive reference voltage to the output of switch 48 and accordingly the input of amplifier 16.

Using the above explanation as applied to FIG. 2, it will be noted that the waveforms of FIG. 2 start with the assumption that the output voltage from amplifier 16 has recently been low enough to activate the upper flip-flop thereby applying a negative feedback reference voltage to the input of amplifier 16. The output of amplifier 16 is driven high enough in one time period such that the upper flip-flop is returned to an inactive condition. Then, for the next six clock periods, no output is supplied from the flip-flop output and therefore no feedback voltage is available for summing with the positive input signal from 12 to amplifier 16. During the eighth time period, the upper flip-flop is again activated. From the ninth to the fifteenth clock time periods, the output from amplifier 16 is again such that neither flip-flop is activated. The circuit thus assumes a stable condition such that an output alternates and continually repeats until there is a change in reference voltage potential or on input voltage potential.

As illustrated, there is a break in FIG. 2 and it illustrates that the input signal of waveform B at time period 24 is as much negative with respect to ground as it was previously positive. Again, the circuit has stablized. However, in this instance the lower flip-flop is periodically activated when the output of amplifier 16 becomes positive by too large an amount. This is illustrated at time period 24 and again at time period 31 wherein a positive feedback voltage is applied through resistor 62 via the activation of the gate switch connecting points 50 and 60 to rapidly drive the output potential of amplifier 16 in a negative direction for one time period.

In FIG. 3, the conditions were assumed that the potential appearing at input 12 is increased by an approximate factor of 3. The rest of the starting conditions as assumed in FIG. 2 were utilized and it will be noted that at time period 8 a stable condition is reached since it again assumes the same conditions as it did at time period 1 and the circuit remains in that configuration repeating the outputs until again either the input or the reference voltages change.

In FIG. 4, the reference voltages ($V_{ref}$) were assumed to be much smaller than previously assumed with the commencing conditions being otherwise the same. Thus, the lower flip-flop is not activated and the upper one is activated at a higher duty rate but the same total energy. As will be noted by the remaining waveforms in FIG. 4, the flip-flop D1 is periodically activated as long as the input conditions are maintained.

In FIG. 5, the conditions of FIG. 3 were assumed except for a larger potential for the reference voltages. Although the pulse rate appears to go down, the energy supplied still remains the same.

If the input signal is altered to a negative voltage rather than a positive voltage, the waveforms G and H will be interchanged and thus the waveform C will effectively be inverted. In summary therefore, the circuitry of FIG. 1 produces an alternating potential output in response to an input signal and this alternating potential output is an inverted representation in the overall integrated value thereof of the signal supplied to input 12.

FIG. 6

Figure 6:
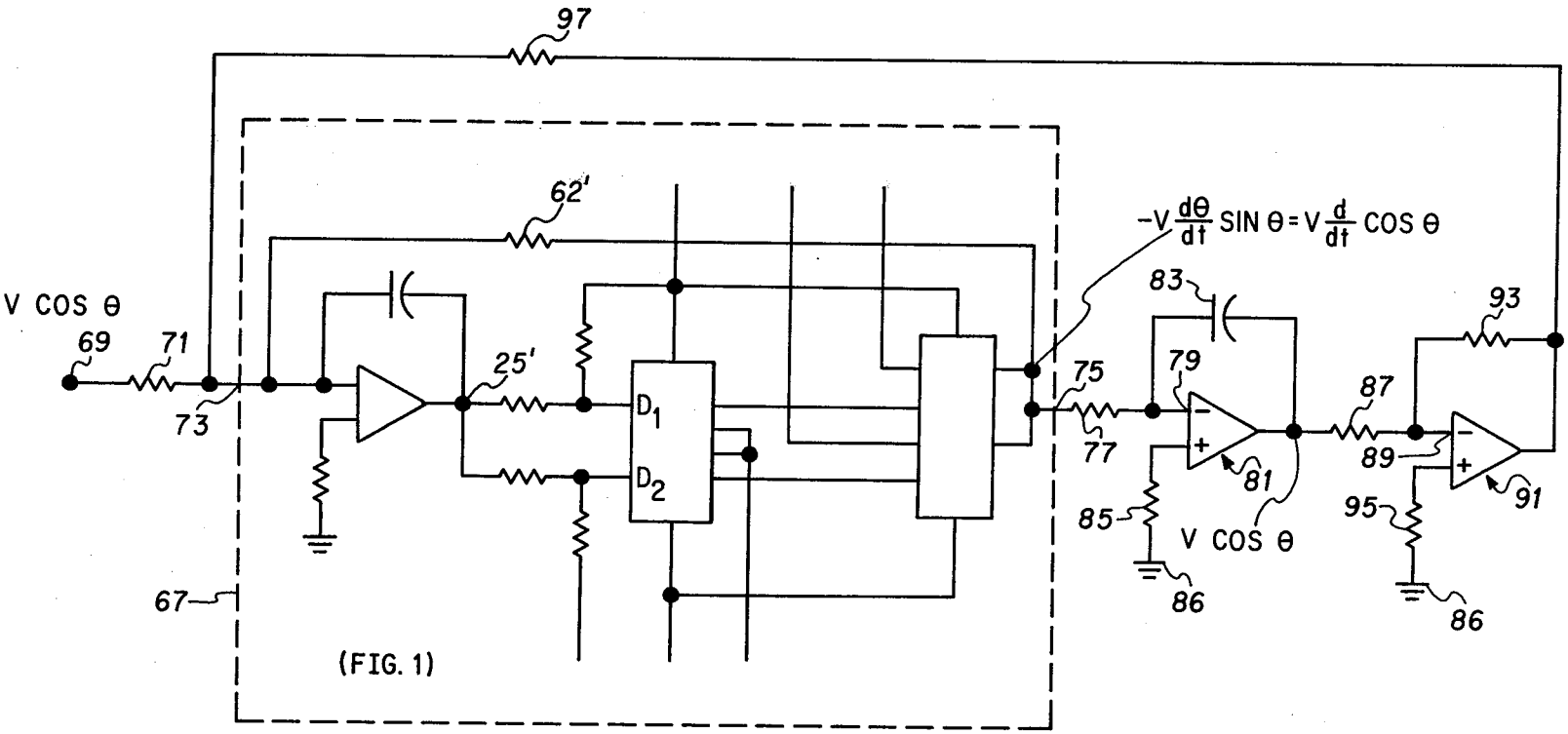
FIG. 6 illustrates a circuit incorporating the duty cycle converter of FIG. 1 for providing derivative switching or control signals.

The duty cycle converter of FIG. 1 is incorporated in a block generally designated as 67 in FIG. 6. A signal representative of Cos$\theta$ is applied at an input 69 through a resistor 71 to an input 73 of block 67. An output from block 67 appears at an output 75 as obtained from the gating means therein. This output signal is a function of the original Cos signal but in view of the added circuitry is more properly termed — $d\theta/dt$ Sin$\theta$. This signal is passed through a resistor 77 to an inverting input 79 of an integrator generally designated as 81 and having a feedback capacitor 83. The non-inverting input is tied through a resistor 85 to ground potential 86. The output of the integrator 81 provides a signal indicative of Cos$\theta$t (part of Vcos$\theta$). This result is obtained from the integration of $d\theta/dt$ Sin$\theta$. The Cos$\theta t$ signal is passed through a resistor 87 to an inverting input 89 of an inverting amplifier 91 having a feedback resistor 93. The non-inverting input of amplifier 91 is connected through a resistor 95 to ground or reference potential 86. The output of amplifier 91 is a signal indicative of −Cos$\theta t$ (part of − $V$cos$\theta t$) and is passed through a feedback resistor 97 to the input 73.

In one embodiment of the invention the feedback resistor 62′ internal block 67 was approximately 1 megohm while the resistors 71 and 97 were in the neighborhood of 10 kilohms each. The requirement for the 1 megohm feedback resistor is due to potential closed loop instability caused by the two integrators the first of which is in block 67 and the second of which is amplifier 81. This feedback resistor 62′ does introduce error signals but these are insignificant and the error signals can be compensated for in the use to be described in conjunction with FIGS. 9 and 10. In the formulas to be used later, the terms K will be utilized to refer to a constant which is the ratio of the feedback resistor 62′ to the resistor 97. Also, the term T is used and this T is equal to the resistance in ohms of resistor 77 times the capacitance in microfarads of capacitor 83. The transfer function from the input to the output of amplifier 81 is $1/T_s$ and the transfer function of the inverting amplifier 91 is $-1$.

The duty cycle of signals appearing at the output 75 of block 67 is proportional to the average amplitude of the current into block 67 at terminal 73. This output is quantized into volt-second pulses with the smallest size being equal in volt-seconds to the clock period times the reference voltage. For good performance, it is desirable to use a clock frequency that is several thousand times the maximum input signal frequency. There is also a nonlinear time lag associated with the duty cycle converter that decreases with increases in clock frequency. It is desirable to have this time lag insignificant with respect to the total circuits by using a high clock frequency. It is desirable to make the speed of the integrators in the duty cycle converter as high as possible but the maximum usable speed is related to the clock frequency. The maximum speed of the integrator should be a value that will cause the output at 25 to change by a value that is slightly less than the voltage difference between the two threshold voltages for the reference voltage applied to resistor 62 for one clock period. The duty cycle converter has a gain that can be described in terms of transimpedance gain. Referring to FIG. 6, the transimpedance gain, defined as the average V output at 75 divided by the input current to 73, is equal to feedback resistor (62') in value. The duty cycle output is equal to the average voltage at 75 divided by the reference voltage.

The closed loop transfer function from 69 to 75 can be expressed as follows:

$$\frac{\frac{R62'}{R71}\cdot}{1+\frac{R62'}{R97}\cdot\frac{R93}{R87}\cdot\frac{1}{T_s}}=\frac{\frac{R97}{R71}\cdot\frac{R87}{R93}\cdot T_s}{\frac{R97}{R62'}\cdot\frac{R87}{R93}\cdot T_s+1}$$

where $T = R77 \cdot R83$. For example if $T = 1$ second, R97 = R71, R87 = R93 and R62' = 100 R97, the transfer function would be S/0.01S+1. This circuit will take the time derivative of the input signal which in this case is V cos $\theta$. If $\theta$ is varying at a rate $d\theta/dt$, the output of the circuit at 75 will be $$\frac{d\theta}{dt}\ \frac{V\sin\theta}{\frac{0.01d\theta}{dt}}(j+1)\cdot$$

The duty cycle is proportional to this voltage.

It might be better to express the transfer function in the form:

$$\frac{K_1T_s}{K_2T_s+1}$$

where $$K_1=\frac{R97}{R71}\cdot\frac{R87}{R93}\text{ and }K_2=\frac{R97}{R62'}\cdot\frac{R87}{R93}\cdot$$

The transfer function from 69 to output of 81 is:

$$\frac{\frac{R97}{R71}\times\frac{R87}{R93}}{\frac{R97}{R62}\cdot\frac{R87}{R93}T_s+1}=\frac{K_1}{K_2T_s+1}\cdot$$

If the input signal at input 69 had been indicative of Sin$\theta$, then the output at 75 would be a constant times the derivative of Sin$\theta$ (or the $V\ d\theta/dt$ cos$\theta$ equivalent) and the output from amplifier 81 would be indicative of Sin$\theta$. Therefore, the output of inverting amplifier 91 would be indicative of $-$Sin$\theta$.

As may be ascertained, the circuit shown in FIG. 6 produces signals indicative not only of the input signal and the inverse thereof but also the derivative of the input angle function.

FIG. 7

In FIG. 7, an input lead 100 is used to supply signals to a block generally designated as 102 (and containing the components of FIG. 6) having an input 104 and first and second outputs 106 and 108. These outputs 106 and 108 represent the switching or control signals obtained from the dual D flip-flop internal block 102 as a result of the Sin$\theta$ indicative signal applied to this block. An output from 106 is obtained when this signal is a negative value and is obtained from 108 when it is positive value. These signals are utilized to operate further switches within a block generally designated as 110. Block 110 is further illustrated in FIG. 8 and by observing the positive and negative input terminals and the orientation thereof with respect to FIG. 8, the position of the switches, their inputs and outputs and control leads may be easily ascertained. As indicated elsewhere herein and in the referenced applications, this entire block 110 may be obtained from RCA under the part number CD4016A. This switching block is used in all the remaining Figures of this application and as 112 in this Figure. While other switching designs may be utilized, this particular circuit is available and operates satisfactorily. The input signal on lead 100 is also supplied via a lead 114 which is connected to pin 11 of block 112. It is also inverted in an inverter 116 and applied to pin 4 of block 112. The two signals are passed through switches during operation thereof and applied to a common junction joint 118 and thence through a resistor 120 to the input of a smoothing filter amplifier 122. The output of filter 122 is supplied to a terminal 124 which provides a signal indicative of negative rate of change of the angle supplied at the inputs of FIG. 7. A further input of FIG. 7 is labeled 126 and supplies a signal indicative of Cos$\theta$ to an input 128 of a block 130 which contains circuitry identical to that of 102. Block 130 incorporates a portion of switch 112. The signal on lead 126 is passed via a lead 132 to an input pin 4 of block 110 and it is also inverted in an inverter 134 and is supplied via a lead 136 to a pin number 11 of block 110. When switches internal block 110 are closed, these leads 132 and 136 supply signals to a common junction 138 and thence through a resistor 140 to the input of smoothing filter 122. The block 130 has two switching output leads designated as 142 and 144 which are connected respectively to pins 12 and 5 of block 112.

As may be ascertained after a reading of the description of operation of FIG. 6 above, the output of the dual D flip-flop internal block 130 provides switching signals to one of 142 and 144 at a rate which is representative of the derivative of theta with respect to time as well as of Sin$\theta$. Since the input on leads 114 and 117 are also indicative of Sin$\theta$ and its inverse, the output appearing at junction 118 is a function of Sin$^2\theta$. More specifically, this signal is equivalent to $$(d\,\theta/dt) \times V^2KT\left(\frac{\mathrm{Sin}\theta t}{T_s+1}\right)^2.$$

The same reasoning applied to the upper differentiating circuit 102 will illustrate that the output signals on 106 and 108 are also representative of the differential of a function of the input angle and more specifically are representative of the differential Cos$\theta$. The signal on lead 126 is supplied directly to pin 4 of block 110 and also inverted and supplied to pin 11 of block 110 such that the output appearing at junction point 138 represents generally Cos$^2\theta$. More specifically, the signals appearing on junction points 118 and 138 are summed by resistors 120 and 140 and smoothed and filtered by filter 122 to appear at the output as $$(d\theta/dt) \times \frac{V^2KT}{(T_s+1)^2} \times [(\mathrm{Sin}\theta t)^2 + (\mathrm{Cos}\theta t)^2].$$

Since $[(\mathrm{Sin}\theta t)^2 + (\mathrm{Cos}\theta t)^2]$ is equal to 1 then the sum of the products is equal to $(d\theta/dt)$ $(V^2KT/Ts+1^2)$. The capacitor and resistor in filter 122 add an additional filtering component to the signal appearing at the output but this signal is still indicative of the derivative of the angle with respect to time as presented by the input terminals 100 and 126. Therefore, the circuit of FIG. 7 provides an output which is indicative of angular rate of change. The rate of change is depicted as negative in view of the inversion thereof in amplifier 122. However, if a positive output is desired at 124, this can be accomplished by the expedient of exchanging the connection at 110 of leads 132 and 136 and exchanging 114 and 117 at block 112.

FIG. 8

Figure 8:
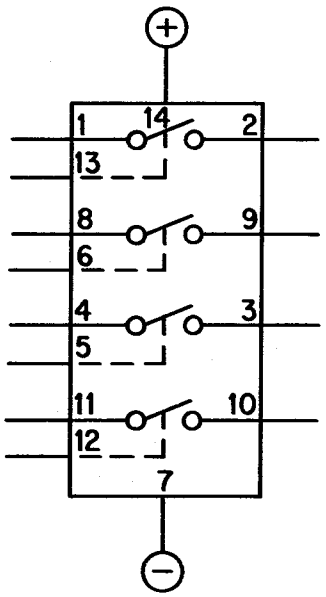
FIG. 8 illustrates the internal connections of one of the blocks utilized in FIGS. 7, 9 and 10.

As indicated previously, the blocks such as 110 in FIG. 7, a portion of which is illustrated as block 48 in FIG. 1 may be of the type designated as CD4016A by RCA. For ease in understanding of the operation of the circuitry of this application, a schematic presentation of this RCA chip is presented in FIG. 8. As illustrated, there are four switches with numbers indicating the pin numbers as used by RCA in the chip sold. While the RCA chip uses solid state logic and switching, the results are as illustrated in FIG. 8. In other words, the application of a logic 1 signal to any of the control leads such as 13 will operate the switch and provide a circuit connection between pins 1 and 2. Positive power is supplied to pin 14 and negative power is supplied to pin 7.

FIG. 9

The circuit of FIG. 9 performs exactly the same function as that of FIG. 7 and operates in a substantially identical way. As illustrated, a Sin$\theta$ is applied to an input 150 of a dash line block generally indicated as 152 having internally an integrating section 154 and an inverting section 156 similar to that of 81 and 91 respectively in FIG. 6. Block 152 is of course the entire FIG. 6 circuit. Further, internal to block 152 is a switch means 158 containing four gate means as illustrated in FIG. 8. A Cos$\theta$ signal is applied to an input 160 of a further FIG. 6 block generally designated as 162 also having an integrator section 164 and an inverting section 166 and a switching block 168.

As mentioned in conjunction with FIG. 6, the output of the integrator in this type of circuit is a direct function of the input signal to the block. Therefore, the output of integrator 154 supplies signals indicative of Sin$\theta t$ to a switched input of switching means 168. This signal is inverted by inverter 156 and supplies $-$Sin$\theta t$ signals to switching block 168. A comparison with FIG. 7 will illustrate that this signal is obtained directly from input 100 in FIG. 7. However, since these signals are already available within block 152, it appears to be simpler and provides an elimination of one inverter to obtain the signals from block 152. Likewise, the Cos$\theta t$ and $-$Cos$\theta t$ are obtained from units 164 and 166 and applied to switching block 158.

The output of these two switching blocks are then combined through summing resistors 170 and 172 and applied to a smoothing filter circuit 174 to provide an output on terminal 176 indicative of $d\theta/dt$ in the same manner as obtained in FIG. 7. As before, and as illustrated in the formulas, the output at 176 is $-d\theta/dt$ and thus an inverter may be required if the polarity of the rate must be the same as the incoming signals.

FIG. 10

The circuitry of FIG. 10 provides the same output as is obtained from either 9 or 7, but accomplishes it in a slightly different manner and adds the feature of normalization to compensate for the variations in the excitation supply to the sine and consine generating devices and to also compensate for scaler errors caused from transformation or the loading of the sine and cosine generating devices.

An input V Sin$\theta$ 200 is used to supply signals to an integrator 202 which supplies output signals to a dual D flip-flop 204. The control leads of the dual D flip-flop are supplied to a first switch 206 and a second switch 208. A V Cos$\theta$ input 210 supplies a signal to an integrator 212 which supplies output signals to a dual D flip-flop 214. The output control leads of flip-flop 214 are supplied to two switches 216 and 218. The integrator 202 in combination with flip-flop 204 and switch 208 provide a closed loop system very similar to that of FIG. 1 except that the feedback signals are obtained from a normalization circuit to be expanded upon later. The integrator 212 along with flip-flop 214 and 216 provide another closed loop system similar to that of FIG. 1. Again, the source of the feedback signals are from the normalization circuit. A smoothing filter generally designated as 220 receives outputs from switch 216 with the duty cycle signal source being + and $-$ reference potentials. Thus, the output from smoothing filter 220 is similar to the input to integrator 212 or in other words Cos$\theta$. This signal is inverted in an inverter 222 and then differentiated in a differentiating circuit 224. Thus, the output of 224 is indicative of $d\theta/dt$ Sin$\theta$. This signal is then inverted in an inverter 226. The output of switch 208 is supplied to a smoothing filter circuit 230 and from there through a differentiating circuit 232 to a further inverting circuit 234. As illustrated, the output of smoothing filter 228 is indicative of Sin$\theta$ while the output of inverter 230 is indicative of $-$Sin$\theta$. The differentiation of $-$Sin$\theta$ results in positive $d\theta/dt$ Cos$\theta$ at the output of differentiator 232. Finally, the output of the inverter 234 is $-d\theta/dt$ Cos$\theta t$.

The outputs of circuits 232 and 234 are used to provide the proper differential Cos functions to switch 218. This switch is operated in accordance with the outputs of the flip-flop 214 in a Cos$\theta$ duty cycle to provide Cos$^2\theta$ indicative signals through a summing resistor 236 to a smoothing filter 238. The output of amplifier 238 appears on a terminal 240 as $-d\theta/dt$ in much the same manner as FIG. 9. The outputs of circuits 224 and 226 are passed to switch 206 to be operated by the flip-flop 204 in a Sin$\theta$ duty cycle to provide a squared function output through a resistor 242 as a second input to smoothing filter 238. Thus, an output is obtained at output 240 which is indicative of the rate of change of the input angle $\theta$.

The input signals V Sin$\theta$ and V Cos$\theta$ are desired to have a specific value for a given $\theta$ since a change in V will result in an error in the $d\theta/dt$ values for circuits as shown in FIGS. 7 and 9. For a given $d\theta/dt$ the output will vary proportional to the square of the voltage V.

For a duty cycle converter of the type shown, the duty cycle is proportional to the input voltage divided by the reference voltage. If the reference voltage varies as a direct function of the variations of the excitation voltage to the sine and cosine generating devices, the duty cycle will be a function only of the sine and cosine of $\theta$ and thus will not vary with excitation voltage. It can thus be seen that scaler errors can cause problems where a highly accurate value of the $d\theta/dt$ is desired. The output of blocks 252 and 256 supply the reference voltage for the duty cycle converters which may be designated as the normalizing reference voltages ($+Vn$) and ($-Vn$).

Since the duty cycle switching signals from flip-flop 204 are proportional to ($V/Vn$) Sin $\theta$, the input to smoothing amplifier 228 will be [($V/Vn$) Sin$\theta$] $V_{ref}$. The output thereof is the same except for the smoothing provided by the amplifier circuit 228 although it may have a predetermined signal gain. The output signals of 228 or the inverter 230 as switched by gate 206 will result in a signal $V^2/(Vn)2[V_{ref}(\text{Sin}\theta)^2]$ and likewise the output of blocks 220 and 222 are switched by gate 216 to result in a signal $V^2/(Vn)2[V_{ref}(\text{Cos}\theta)^2]$. A summing of these two signals by resistors 248 and 244 will be equal to $V^2/Vn2[V_{ref}(\text{Sin}\theta^2+\text{Cos}\theta^2)]$. Since trigonometrically $\text{Sin}\theta^2 + \text{Cos}\theta^2=1$, the sum will be $V^2/Vn2\ V_{ref}$. Comparing this signal to $V_{ref}$ (a voltage obtained from lead 245) by subtraction will result in an error signal equal to the error of $(V^2/Vn^2)\ V_{ref}-K_4\ V_{ref}$. This error signal is achieved in the circuit by the summing of the currents through resistor 248, resistor 244 and the resistor from the negative reference supply 245 to the input inverting terminal of 246. Block 246 is an integrating amplifier that provides an input to amplifier 252 through resistor 250. The comparison at this amplifier will change the value of $Vn$ to give the desired ratio of $V/Vn$. Compensation for fast changes in V can be made by supplying the input 254 from a voltage source that is proportional to the excitation voltage for the sine and cosine generating devices. This will result in a duty cycle switching signal from 204 that is proportional to sine $\theta$ and a duty cycle switching signal from 214 proportional to cosine $\theta$.

While several embodiments of rate deriving circuits have been illustrated, some of which are closed loop and some of which are not closed loop, and one of which illustrates normalization to provide increased long term stability, I wish to be limited not to the embodiments illustrated by only to the inventive concept as defined in the claims since it will be obvious to those skilled in the art from reading the specification that other circuits may be used to practice my invention.

What is claimed is:

1. Angular rate deriving apparatus comprising, in combination:

first duty cycle means for supplying output control signals having a duty cycle representative of $d\theta/dt$ and Cos$\theta$;

second duty cycle means for supplying output control signals having a duty cycle representative of $d\theta/dt$ and Sin$\theta$;

means, connected to said first duty cycle means, for supplying a signal representing Sin $\theta$ thereto whereby said first duty cycle means converts it to a signal indicative of $d\theta/dt$ Cos$\theta$;

means, connected to said second duty cycle means, for supplying a signal representing Cos$\theta$ thereto whereby said second duty cycle means converts it to a signal indicative of $d\theta/dt$ Sin$\theta$;

first switch means, connected to said first duty cycle means for receiving control signals therefrom, for supplying output Cos$\theta$ representative signals at a duty cycle in accordance with received control signals whereby the output signals are representative of $d\theta/dt$ Cos$^2\theta$;

second switch means, connected to said second duty cycle means for receiving control signals therefrom, for supplying output Sin$\theta$ representative signals at a duty cycle in accordance with received control signals whereby the output signals are representative of $d\theta/dt$ Sin$^2\theta$; and summing means connected to said first and second switch means for receiving the output signals therefrom, said summing supplying, as an output signal, an output representative of the rate of change, ($d\theta/dt$), of the angle $\theta$.

2. Apparatus for deriving the rate of change of an angle $\theta$ comprising, in combination:

first signal means for supplying a first signal representative of $d\theta/dt$ cos$\theta$ wherein said first signal means is a duty cycle converter for converting an input signal of Sin$\theta$ and including interconnected integrating means, voltage sensitive means for switching reference voltage signals, and means for supplying as feedback signals to said integrating means the reference signals to obtain an output signal indicative in duty cycle of Cos$\theta$;

second signal means for supplying a second signal representative of Cos$\theta$;

third signal means for supplying a third signal representative of $d\theta/dt$ Sin$\theta$ wherein said third signal means is a duty cycle converter for converting an input signal of Cos$\theta$ and includes interconnected integrating means, voltage sensitive means for switching reference voltage signals, and means for supplying as feedback signals to said integrating means the reference signals to obtain an output signal indicative in duty cycle of Sin$\theta$;

fourth signal means for supplying a fourth signal representative of Sin$\theta$;

first multiplying means connected to said first and second signal means for receiving said first and second signals therefrom and providing as an output a signal indicative of the derivative of the angle $\theta$ and of $\text{Cos}^2\theta$ by passing one signal as a duty cycle function of the other;

second multiplying means connected to said third and fourth signals therefrom and providing as an output a signal indicative of the derivative of the angle $\theta$ and of $\text{Sin}^2\theta$ by passing one signal as a duty cycle function of the other; and summing means, connected to said first and second multiplying means for receiving output signals therefrom, for providing as an apparatus output a signal indicative of the derivative of the angle $\theta$.

3. Apparatus for deriving the rate of change of an angle $\theta$ comprising, in combination:

first signal means for supplying a first signal representative of $d\theta/dt$ $\cos\theta$;

second signal means for supplying a second signal representative of $\text{Cos}\theta$ wherein said second signal means is a duty cycle converter for converting an input signal of $\text{Sin}\theta$ and includes interconnected integrating means, voltage sensitive means for switching reference voltage signals, and means for supplying as feedback signals to said integrating means the reference signals to obtain an output signal indicative of duty cycle of $\text{Cos}\theta$;

third signal means for supplying a third signal representative of $d\theta/dt$ $\text{Sin}\theta$;

fourth signal means for supplying a fourth signal representative of $\text{Sin}\theta$ wherein said fourth signal means is a duty cycle converter for converting an input signal of $\text{Cos}\theta$ and includes interconnected integrating means, voltage sensitive means for switching reference voltage signals, and means for supplying as feedback signals to said integrating means the reference signals to obtain an output signal indicative of duty cycle of $\text{Sin}\theta$;

first multiplying means connected to said first and second signal means for receiving said first and second signals therefrom and providing as an output a signal indicative of the derivative of the angle $\theta$ and of $\text{Cos}^2\theta$ by passing one signal as a duty cycle function of the other;

second multiplying means connected to said third and fourth signal means for receiving said third and fouth signals therefrom and providing as an output a signal indicative of the derivative of the angle $\theta$ and of $\text{Sin}^2\theta$ by passing one signal as a duty cycle function of the other; and summing means, connected to said first and second multiplying means for receiving output signals therefrom, for providing as an apparatus output a signal indicative of the derivative of the angle $\theta$.

4. Apparatus as claimed in claim 3 comprising, in addition:

fifth means, connected to said second signal means for providing output analog fifth signals representative in amplitude of $\text{Cos}\theta$;

sixth means, connected to said fourth signal means for providing output analog sixth signals representative in amplitude of $\text{Sin}\theta$;

third multiplying means connected to said second signal means and said fifth means for receiving output signals therefrom and supplying as output product seventh signals representative of $\text{Cos}^2\theta$;

fourth multiplying means connected to said fourth signal means and said sixth means for receiving output signals therefrom and supplying as output product eighth signals representative of $\text{Sin}^2\theta$;

means for supplying a further reference signal;

comparison means, connected to said last named means, said third multiplying means and said fourth multiplying means for receiving output signals therefrom, said comparison means providing output reference signals at an output means thereof which change in amplitude as a function of the difference between said further reference signal and the sum of said seventh and eighth signals; and means connecting said output means of said comparison means to said second and fourth signal means for supplying reference voltage signals thereto.

* * * * *